US006108981A

United States Patent [19]

Sama et al.

[11] Patent Number: 6,108,981

[45] Date of Patent: Aug. 29, 2000

[54] SURFACE MOUNT COUNTER FLASHING SYSTEM

[75] Inventors: Joseph A. Sama, Wadsworth; John D. Bishop, Bellefontaine, both of Ohio

[73] Assignee: Tremco Incorporated, Beachwood, Ohio

[21] Appl. No.: 09/289,560

[22] Filed: Apr. 9, 1999

[51] Int. Cl.[7] ..... E04D 1/346; E04D 13/14

[52] U.S. Cl. ..... 52/60; 52/58; 52/62

[58] Field of Search ..... 52/58, 60

[56] References Cited

U.S. PATENT DOCUMENTS

| | | | |
|---|---|---|---|
| 3,365,847 | 1/1968 | Josek | 52/58 |
| 3,981,108 | 9/1976 | Berg . | |
| 4,156,993 | 6/1979 | Sorrells, Jr. . | |
| 4,190,989 | 3/1980 | Sakharoff | 52/60 |
| 5,123,208 | 6/1992 | Kirby et al. . | |
| 5,381,632 | 1/1995 | Damron . | |
| 5,706,611 | 1/1998 | Attaway et al. | 52/60 |

*Primary Examiner*—Carl D. Friedman
*Assistant Examiner*—Patrick J. Chavez
*Attorney, Agent, or Firm*—Calfee, Halter & Griswold LLP

[57] ABSTRACT

A surface mounted counter flashing system and method is provided for securing and sealing a free end of a roofing material to a wall. A compression plate secures and compressingly seals the free end of a roofing material against the wall surface. The top end of the compression plate defines a first sealing trough for receiving a sealing material. The bottom end of the compression plate includes locking portion for attachment to a counter flashing. The counter flashing includes a mounting surface which is mounted to the wall above compression plate. A covering surface extends out from the mounting surface and encloses the compression plate protecting it from exposure to weather. A locking member is provided on the covering surface which connects and attaches to the compression plate, thus, securing the counter flashing. The top end of the counter flashing defines a second sealing trough for receiving the sealing material. Adjacent counter flashings are installed end-to-end leaving a gap therebetween. A splice plate is attached to the adjacent counter flashings at the second sealing trough and covers the gap. The gap and splice plate allow for movement of the counter flashings. The present invention provides for easy assembly and disassembly of the components and provides for a long lasting seal.

15 Claims, 2 Drawing Sheets

SURFACE MOUNT COUNTER FLASHING SYSTEM

BACKGROUND OF THE INVENTION

The present invention is directed to the roofing arts. It finds particular application to a surface mounted counter flashing system and method that seals roofing material. It is to be appreciated that the present invention also finds application to other roof and wall sealing systems which may include reglets, flashings, and/or coping structures.

Reglet, flashing, and counter flashing devices have been used to form water-tight seals and covers for joints or termination areas of different wall materials of roofs. Many of these prior art devices have been found to be difficult to assemble and install, and have been unsatisfactory in installations covering the termination of a water-proof roofing membrane extending along a portion of the wall. In addition, longitudinally adjacent sections of these devices have been difficult to properly align, thus, presenting the possibility of leaks at adjoining section joints. This makes a precise installation difficult and expensive to achieve. Additionally, installation forces exerted on the components of some prior art reglet or flashing structures cause the components to rotate or be pulled. As a result, sealants may pull away from the wall and/or break between adjoining sections causing adverse effects to the water-proofing performance of the wall membranes. Furthermore, many prior art reglet, flashing and counter flashing assemblies have not properly allowed for longitudinal expansion or movement of sections mounted end-to-end. Movement of adjacent sections which are sealed at their joint can break the seal and present the possibility of leakage.

The present invention provides a new and unique surface mount counter flashing system and method which cures the above problems and others.

SUMMARY OF THE INVENTION

In accordance with the present invention, a surface mount counter flashing system is provided for sealing a roofing material to a wall surface. The system includes a compression plate which attaches to the wall surface and compressingly seals the roofing material against the wall surface. A counter flashing includes an attaching surface which attaches to the wall. A free surface extends out from the attaching surface and encloses the compression plate to restrict exposure of the compression plate to weather. The free surface connects to the compression plate to secure the free surface of the counter flashing.

In accordance with a more limited aspect of the present invention, a second counter flashing is attached to the wall adjacent and end-to-end with the counter flashing such that a gap is defined therebetween. A splice plate is attached to both adjacent counter flashings and covers the gap.

In accordance with a more limited aspect of the present invention, the compression plate provides a first sealing trough filled with a sealing material and the counter flashing provides a second sealing trough filled with a sealing material. The two sealing troughs provide double protection to prevent fluid from leaking between the roofing material and the wall.

In accordance with another aspect of the present invention, a process for securing and sealing a free end of a roofing material to a wall is provided. The free end of the roofing material is compressingly sealed against the wall by a compression plate where the compression plate includes a first edge and a locking edge. The first edge defines a first trough between the wall. The first trough is filled with a sealing material. A counter flashing is provided which has a mounting surface and a covering surface extending therefrom. The mounting surface of the counter flashing is attached to the wall above the compression plate such that the covering surface encloses the compression plate. The mounting surface includes a lip extending out therefrom which defines a second trough between the wall. The covering surface is then secured to the locking edge of the compression plate and the second trough is filled with a sealing material.

One advantage of the present invention is that the components quickly and easily attach to one another simplifying installation and removal of the system.

Another advantage of the present invention is that adjacent counter flashings are aligned leaving a gap therebetween which allows the counter flashings to move. Since a splice plate covers the gap, sealing the joints is not necessary.

Another advantage of the present invention is that the compression plate is enclosed by the counter flashing protecting from weather and ultra violet rays which extends the life and functionality of the compression plate and its seal.

Another advantage of the present invention is that it provides dual fluid sealing by providing two sealing troughs.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
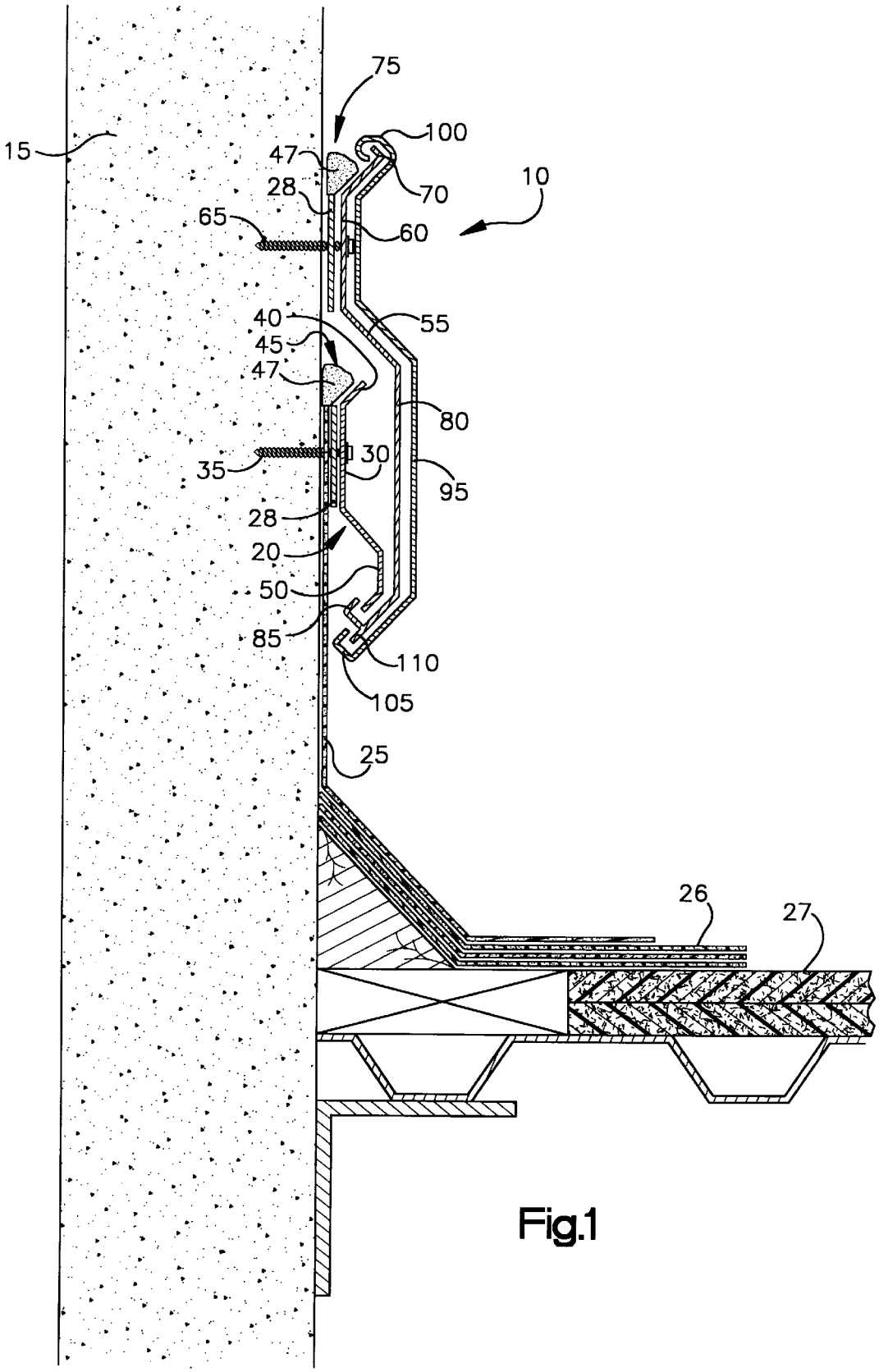
FIG. 1 is a cross-sectional view of the present invention mounted to a vertical wall.

With reference to FIG. 1, the present surface mounted counter flashing system 10 is shown mounted to a wall surface 15, for example, a vertical wall as shown. A compression plate 20 secures an end of a roofing material 25 against the vertical wall 15 forming a compression seal therebetween. Preferably, the compression plate 20 is made from extruded aluminum, steel or other metal. The roofing material 25 covers built-up-roofing 26, such as asphalt, which covers a roof 27. Optionally, an elastomeric tape 28 may be placed between the compression plate 20 and the roofing material 25.

The compression plate 20 includes a body portion 30 which is fastened to the wall by a plurality of fasteners 35. At one end of the compression plate 20, an edge 40 extends out from the body 30 such that it projects away from the wall 15 when mounted. A first sealing trough 45 is formed between the wall 15 and the edge 40 which is filled with a sealing material 47 such as caulk to prevent fluid from flowing between the compression plate 20 and the wall. At the other end of the compression plate 20, a locking portion 50 is formed. The locking portion extends out from the body 30 away from the wall 15 and, preferably, bends back at its end. Alternatively, it may be parallel to or bent away from the wall. The locking portion 50 provides for easy assembly and snap connection to a counter flashing 55 as described below.

With further reference to FIG. 1, the system 10 includes a counter flashing 55 mounted to the wall 15 at a position above the compression plate 20. Preferably, the counter flashing 55 is made from extruded aluminum, steel or other metal. It is attached at a mounting portion or surface 60 using a plurality of fasteners 65. The mounting portion 60, as well as the other components, are shown spaced from the wall 15 and from each other only for clarity and are not actually installed with such spaces. At a top end, a trough edge 70 extends out from the mounting portion 60. When the counter flashing is mounted, the trough edge 70 projects away from the wall 15 forming a second sealing trough 75 which receives a sealing material 47. Once sealed, water and other fluids are prevented from leaking between the wall 15 and the counter flashing 55.

The counter flashing 55 includes a covering portion or surface 80 which extends out from the mounting portion 60 and terminates as a free end. The covering portion 80 has a sufficient length to cover the compression plate 20. In this manner, the compression plate is protected from exposure to weather and ultra violet rays, thus, extending the life of the compression plate 20 and the sealing material. Furthermore, the first and second sealing troughs 45 and 75 provide dual protection to prevent fluid from reaching between the roofing material 25 and the wall 15.

The counter flashing 55 may be formed to have any desired geometry which encloses the compression plate 20. To attach the counter flashing, the covering portion 80 includes a locking member 85. Preferably, the locking member 85 has a hook-like configuration for easy connection and disconnection to the locking portion 50 of the compression plate 20. Of course, depending upon the sizes and shapes chosen for the compression plate 20 and counter flashing 55, the locking member 85 maybe positioned at any suitable location along the counter flashing and shaped to attach to the compression plate 20.

Figure 2:
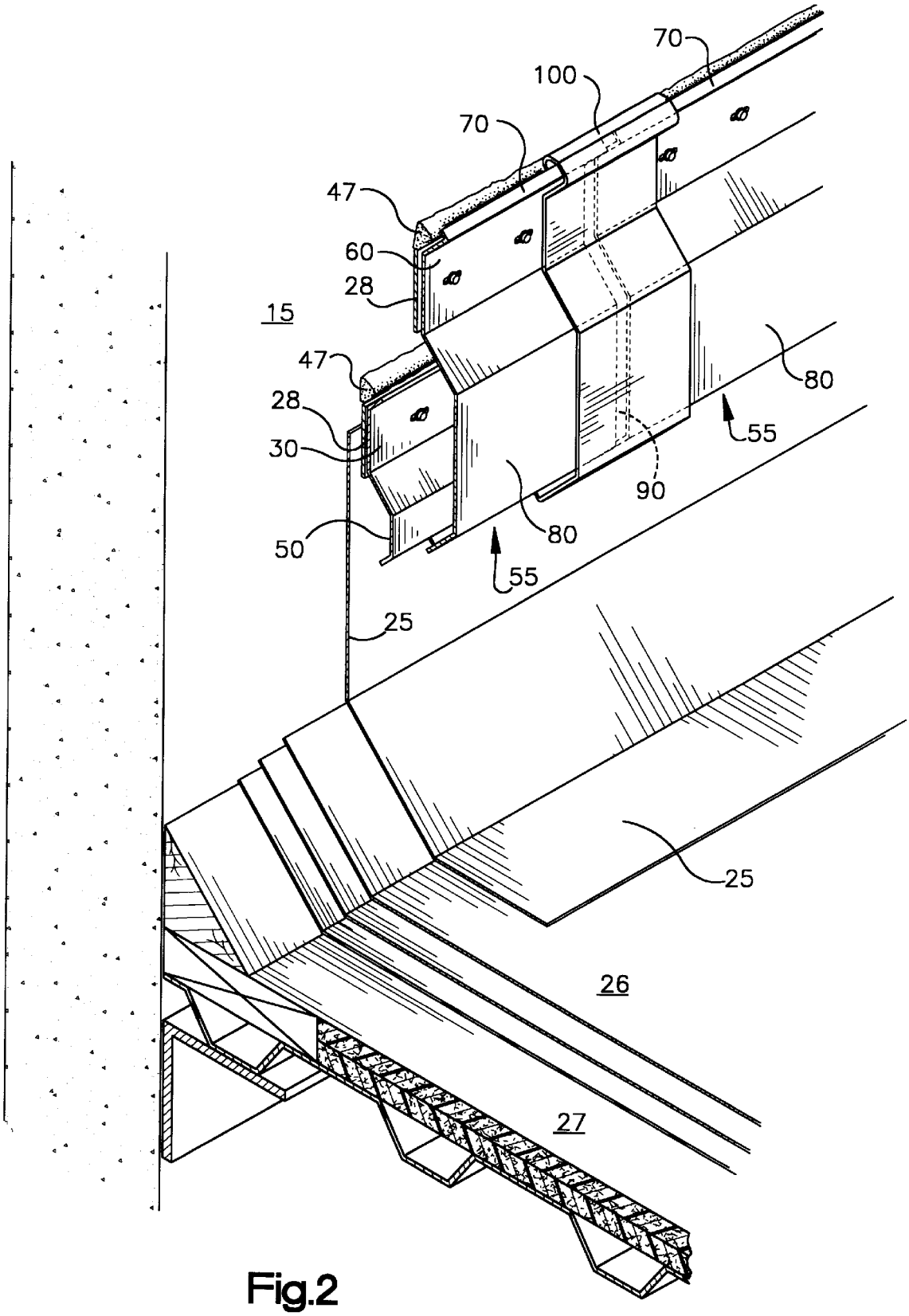
FIG. 2 is an isometric view of the present invention illustrating a splice plate connection.

With continued reference to FIG. 1 and FIG. 2, since wall 15 typically has a length which is longer than the length of a single compression plate 20 and a single counter flashing 55, the present system 10 is installed using a plurality of compression plates and counter flashings mounted in an end-to-end sequence along the wall 15. In the preferred embodiment, the compression plate 20 and counter flashing 55 each have a length of about ten feet. Of course, any length can be used. Adjacent counter flashings 55 are preferably aligned such that a gap 90 is provided between adjacent ends. The gap 90 allows for movement of adjacent counter flashings 55. A splice plate 95 is then mounted and attached to the adjacent counter flashings such that the gap 90 is covered. The splice plate 95 prevents fluid from leaking through the gap.

As best seen in FIG. 1, the splice plate 95 is formed to substantially match the geometry of the counter flashing 55. A top end 100 is shaped such that it attaches and mounts to the trough edge 70 of the counter flashing. A bottom end 105 is shaped to attach and mount to the bottom end of the counter flashing 55 around the locking member 85. In the preferred embodiment, a connecting lip 110 extends from about the end of the counter flashing 55 to which the bottom end 105 of the splice plate 95 attaches. The attachment of the splice plate 95 allows it to slide along the counter flashing 55 should the counter flashing move during installation or thereafter. Thus, even if components of the system shift, the gap 90 will still be covered and sealed by the splice plate 95. The present system eliminates the need to precisely align adjacent counter flashings and eliminates overlapping of counter flashings which then need to be sealed with a caulking material.

The connectivity of the compression plate 20, the counter flashing 55 and the splice plate 95 allows for quick and easy installation. Of course, one of ordinary skill in the art will appreciate that there are many ways to form the components of the present invention so that they cooperatively attach to each other, for example, by hooking, snapping or the like.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

We claim:

1. A roof counter flashing system, the system comprising:
- a compression plate having a body which is attached to a roofing material and a vertical wall and forming a compression seal against the roofing material, the body including a first end and a second end where the first end is positioned above the second end on the vertical wall;
- a first sealing trough defined between the first end of the compression plate and the vertical wall for receiving a sealing material;
- a counter flashing comprising:
  - a mounting portion attached to the vertical wall above the compression plate forming a compression seal against the vertical wall;
  - a covering portion which extends from the mounting portion and covers the compression plate, the covering portion including a locking member for locking the covering portion to the second end of the compression plate; and
  - a mounting edge extending from a top end of the mounting portion;
- a second sealing trough formed between the mounting edge and the vertical wall for receiving a sealing material which prohibits fluid from flowing between the mounting portion and the vertical wall; and
- a splice plate for covering a portion of the counter flashing, the splice plate having a first end attached to the mounting edge of the counter flashing and a second end attached to the covering portion.

2. The roof counter flashing system as set forth in claim 1 further including:
- a plurality of compression plates attached to the wall in an adjacent end-to-end relationship; and
- a plurality of counter flashings attached to the wall in an adjacent end-to-end relationship and defining a gap between adjacent counter flashings such that the splice plate is attached to adjacent counter flashings to cover the gap.

3. The roof counter flashing system as set forth in claim 1 wherein the counter flashing further includes a connecting lip extending from the covering portion such that the second end of the splice plate attaches to the connecting lip.

4. The roof counter flashing system as set forth in claim 1 wherein the splice plate is slideable along the counter flashing allowing movement by the counter flashing.

5. The roof counter flashing system as set forth in claim 1 wherein the splice plate includes a geometry that substantially matches a geometry of the counter flashing.

6. The roof counter flashing system as set forth in claim 1 wherein the locking member is formed to attach around the second end of the compression plate.

7. A surface mount counter flashing system, the system comprising:

a compression plate for attachment to a wall surface and compressingly sealing a roofing material against the wall surface; and a counter flashing having a mounting portion attached to the vertical wall above the compression plate forming a compression seal against the vertical wall and a free surface extending from the mounting portion and enclosing the compression plate to restrict exposure of the compression plate to weather, the free surface being connectable to the compression plate to secure the free surface; and a mounting edge extending from a top end of the mounting portion;

a splice plate for covering a portion of the counter flashing, the splice plate having a first end attached to the mounting edge of the counter flashing and a second end attached to the free surface.

8. The surface mount flashing system as set forth in claim 7 further including:

a second counter flashing for attachment to the wall surface adjacent and end-to-end with the counter flashing such that a gap is defined therebetween; and a splice plate being attached to both the counter flashing and second counter flashing wherein the splice plate covers the gap.

9. The surface mount flashing system as set forth in claim 8 further including a trough edge extending out from the attaching surface of the counter flashing, and the splice plate includes a top end connectable to the trough edge and a bottom end connectable to the free surface of the counter flashing to secure the splice plate to the counter flashing.

10. The surface mount flashing system as set forth in claim 9 wherein the trough edge forms a trough between the wall for receiving a sealing material to prevent fluid from entering between the counter flashing and the wall.

11. The surface mount flashing system as set forth in claim 7 wherein the free surface includes a locking member for connecting to the compression plate, the locking member having a generally hook shape which attaches to the compression plate.

12. The surface mount flashing system as set forth in claim 7 wherein the compression plate further includes a first end extending away from the wall to define a compression plate trough for receiving a sealing material to prevent fluid from entering between the compression plate and the wall.

13. The surface mount flashing system as set forth in claim 12 wherein the compression plate further includes a second end opposite from the first end which forms a locking portion for securing the free surface of the counter flashing.

14. The surface mount flashing system as set forth in claim 13 wherein the counter flashing further includes a mounting edge extending out from the attaching surface and away from the wall which defines a flashing trough for receiving a sealing material to prevent fluid from entering between the counter flashing and the wall.

15. A process comprising the steps of:

attaching a compression plate to a roofing material and a wall, the compression plate having a first edge and a locking edge, the first edge defining a first trough between the wall;

filling the first trough with a sealing material;

providing a counter flashing having a mounting surface and a covering surface extending therefrom;

attaching the mounting surface of the counter flashing to the wall above the compression plate forming a compression seal against the wall; such that the covering surface encloses the compression plate, the mounting surface including a trough edge extending out therefrom defining a second trough between the wall;

securing the covering surface to the locking edge of the compression plate; and filling the second trough with a sealing material; and attaching a second counter flashing to the wall in an end-to-end relationship with the counter flashing such that a gap is defined between ends; and attaching a moveable splice plate between the second trough edge and the covering surface overlapping both of the adjacent counter flashing such that the gap is covered by the splice plate.

* * * * *